US007605319B2

(12) United States Patent
Komatsu

(10) Patent No.: US 7,605,319 B2
(45) Date of Patent: Oct. 20, 2009

(54) KEYBOARD APPARATUS

(75) Inventor: Akihiko Komatsu, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 12/253,116

(22) Filed: Oct. 16, 2008

(65) Prior Publication Data

US 2009/0100986 A1 Apr. 23, 2009

(30) Foreign Application Priority Data

Oct. 19, 2007 (JP) ..... 2007-272601

(51) Int. Cl.
*G10D 13/02* (2006.01)

(52) U.S. Cl. ..... 84/423 R

(58) Field of Classification Search ..... 84/433–437
See application file for complete search history.

(56) References Cited

U.S. PATENT DOCUMENTS 3,068,334 A * 12/1962 Gibbs et al. ..... 200/246
6,894,211 B2 * 5/2005 Asahi ..... 84/423 R

FOREIGN PATENT DOCUMENTS

JP 4057093 2/1992
JP 10020857 1/1998

* cited by examiner

*Primary Examiner*—Kimberly R Lockett
(74) *Attorney, Agent, or Firm*—Morrison & Foerster LLP

(57) ABSTRACT

A keyboard apparatus 100 has plural keys 10 and 11, plural electronic actuators 30, and plural link mechanisms 40. Each of the keys 10 and 11 extends in the longitudinal direction, and pivots in the vertical direction about a support C1 by the operation of depressing the keys and the operation of releasing the keys. Each of the electronic actuators 30 has a movable member 31 that displaces in the vertical direction in interlocking with the pivot movement of each of the keys, and applies a reaction force against the operation of depressing the keys 10 and 11. Each of the link mechanisms 40 links each of the keys 10 and 11 and the movable member of each of the electronic actuators 30 in such a manner that power can be transmitted. Each of the link mechanisms 40 has a plate-like first fixing portion 41 that is fixed to each of the keys, a plate-like second fixing portion 42 that is connected to each of the movable members 31, and plural spherical fine grains 43 filled in a gap between the first fixing portion 41 and the second fixing portion 42.

4 Claims, 4 Drawing Sheets

KEYBOARD APPARATUS

BACKGROUND OF THE INVENTION

1. Field of the Invention

The present invention relates to a keyboard apparatus having plural keys, and more particularly to a keyboard apparatus having electronic actuators that apply a reaction force with respect to the operation of depressing the plural keys.

2. Description of the Related Art

A natural keyboard instrument such as an acoustic piano or the like is configured to generate a live sound by a hammer, which rotates with the key depression, striking a string, for example. The natural keyboard apparatus of this type has a so-called action mechanism provided between a key, which is a performance operation element, and a hammer. A player receives a unique reaction force (key damping force) from the key by this action mechanism. Specifically, a feeling of a key touch specific to the natural keyboard instrument can be obtained by providing the action mechanism.

On the other hand, in a conventional electronic keyboard instrument, such as an electronic piano, that generates an electronic sound, a mechanical structure, such as a spring or a mass body (hammer) member, that returns a key to an initial position is provided in order to simulate a touch feeling of a natural keyboard apparatus such as an acoustic piano. A player operates a key against the returning force of the spring or the mass body member when he/she depresses the key. In general, the mechanical structure of the electronic keyboard apparatus is compact and not complicated, compared to the action mechanism of the natural keyboard apparatus, so that the touch feeling of a key in the electronic keyboard apparatus is different from the touch feeling of the natural keyboard apparatus, to be strict.

In view of this, there has been proposed a keyboard apparatus in which a key is driven by driving means, such as an electromagnetic solenoid, for changing the reaction force against the key depression, in order to provide a touch feeling similar to that of a natural keyboard instrument in an electronic keyboard instrument. In the keyboard apparatus using the electromagnetic solenoid, a plunger (movable member) of the electromagnetic solenoid, which linearly moves in the vertical direction, and a key that pivots about a support should be engaged with each other so as to be capable of transmitting power. As a keyboard apparatus in which the plunger and the key is engaged with each other, there has been proposed a keyboard apparatus in which a groove is formed along the longitudinal direction of the key, and the leading end of the plunger is fitted into the groove so as to be slidable in the longitudinal direction (see Japanese Examined Patent Application No. HEI7-111631). However, in the conventional keyboard apparatus described above, the engagement structure is complicated, and a friction caused by the sliding movement is generated. Further, the conventional keyboard apparatus also entails a problem that looseness is produced between the groove formed to the key and the leading end of the plunger, which affects a feeling of a touch when the key is depressed.

As a keyboard apparatus that suppresses the looseness at the contact point of the key and the plunger to the minimum level, there has been proposed a keyboard apparatus including a key-depression-direction biasing member that biases the key in the key-depressing direction, and a key-release-direction biasing member that biases the key toward the key-release direction, and balances the key at a rest position in cooperation with the key-depression-direction biasing member (see Japanese Unexamined Patent Application No. HEI10-20857). It is to be noted that the rest position is the position where the biasing force of the key-depression-direction biasing member and the biasing force of the key-release-direction biasing member are balanced. However, in the conventional keyboard apparatus described above, the balance between the key-depression-direction biasing member and the key-release-direction biasing member affects the feeling of a touch upon the key depression. Therefore, the key-depression-direction biasing member and the key-release-direction biasing member should correctly be adjusted in order to balance the key at the rest position. The problem is that the adjustment described above is extremely difficult.

SUMMARY OF THE INVENTION

In view of the foregoing circumstance, the present invention aims to provide a keyboard apparatus that suppresses as much as possible a friction force or looseness caused by an engagement between a key and a movable member.

In order to solve the aforesaid problem, the keyboard apparatus according to the present invention includes plural keys, electronic actuators, and link mechanisms. Each of the plural keys extends in the longitudinal direction, and pivots in the vertical direction about a support in accordance with the key depression and key release. Each of the plural electronic actuators has a movable member that displaces in the vertical direction in interlocking with the pivot movement of each of the keys so as to apply a reaction force against the operation of depressing the key. Each of the link mechanisms links each of the keys and the movable member of each of the electronic actuators in such a manner that power can be transmitted. Each of the link mechanisms has a plate-like first fixing portion that is fixed to the corresponding key, a plate-like second fixing portion that is connected to the corresponding movable member, and plural spherical fine grains filled in a gap between the first fixing portion and the second fixing portion.

In this case, each of the electronic actuators is an electromagnetic solenoid. The first fixing portion and the second fixing portion may be made of a conductive material, and a voltage may be applied between the first fixing portion and the second fixing portion so as to exert an electrostatic attraction force between the first fixing portion and the second fixing portion. Alternatively, at least one of the first fixing portion and the second fixing portion may be made of a magnet so as to exert an attraction force caused by a magnetic force between the first fixing portion and the second fixing portion.

According to the present invention thus configured, the first fixing portion and the second fixing portion relatively move as accompanying the rotation of the spherical grains when a key is depressed or released, whereby a friction force and looseness caused by the engagement between the key and the movable member can be suppressed as much as possible with a simple structure. Further, the gap between the first fixing portion and the second fixing portion is always kept to be apart from each other by the diameter of the spherical grains, if an attraction force is exerted between the first fixing portion and the second fixing portion by an electrostatic attraction force or a magnetic force.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT a. First Embodiment

Figure 1:
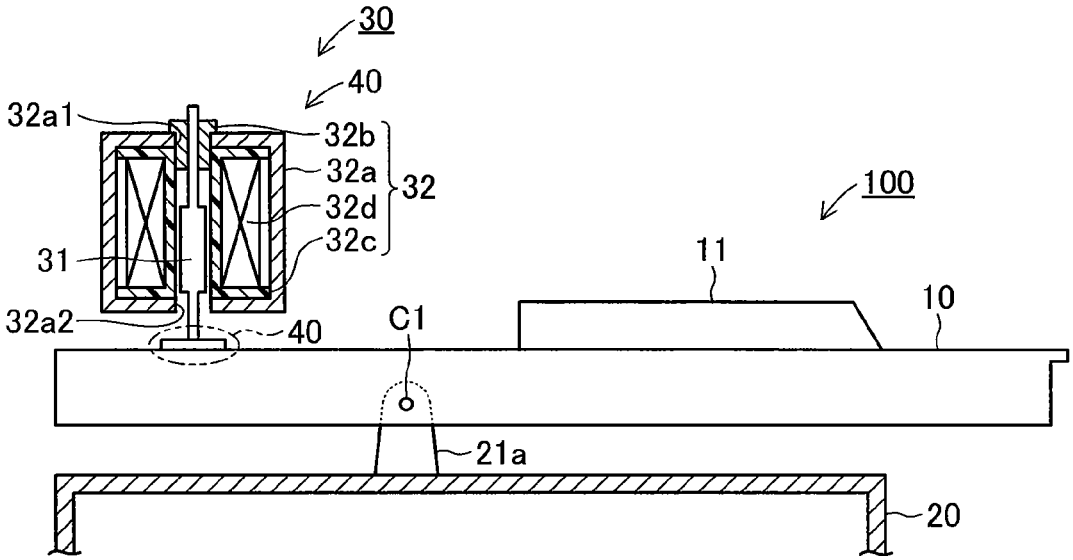
FIG. 1 is a schematic sectional view showing an embodiment of a keyboard apparatus according to the present invention.
Figure 2:
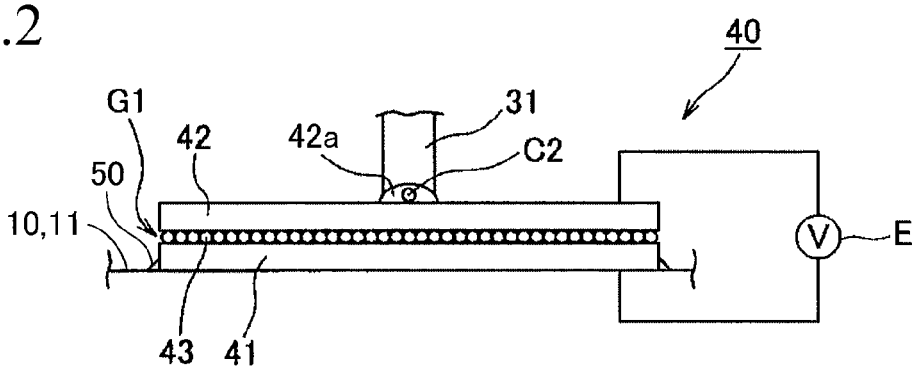
FIG. 2 is an enlarged view of the joint portion shown in FIG. 1 in its initial state (key release state)
Figure 3:
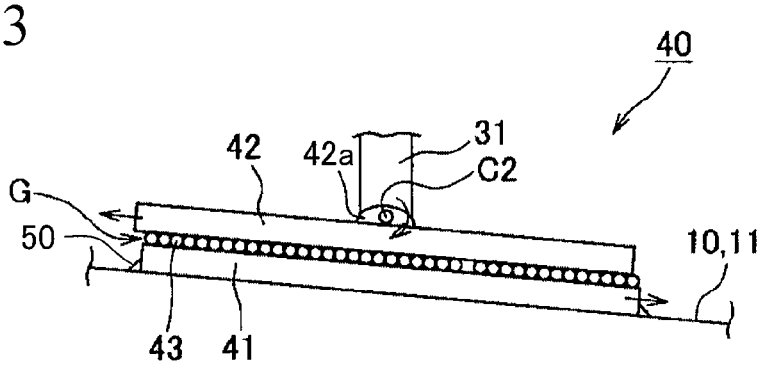
FIG. 3 is an enlarged view of the joint portion shown in FIG. 1 in its key depression state.

A first embodiment of the present invention will be described below with reference to the drawings. FIG. 1 is a schematic sectional view showing an embodiment of a keyboard apparatus 100 according to the present invention. FIG. 2 is an enlarged view of a link mechanism 40 shown in FIG. 1 in its initial state (key release state). FIG. 3 is an enlarged view of the link mechanism 40 shown in FIG. 1 in its key depression state. In the description below, the "vertical direction, lateral direction, and longitudinal direction" of the keyboard apparatus 100 mean the "vertical direction, lateral direction, and longitudinal direction" as viewed from a player who plays the keyboard apparatus 100.

The keyboard apparatus 100 is used for an electronic keyboard instrument, for example. As shown in the figures, the keyboard apparatus 100 includes plural white keys 10 and black keys 11, which serve as performance operation elements, a frame 20, and magnetic solenoids 30 serving as driving means. The white keys 10 and the black keys 11 are juxtaposed in the lateral direction. The frame 20 is formed to have a plate-like shape, or a box-like shape having an opening at the bottom surface thereof. Speed sensors (not shown) for detecting the key depression speed of the white keys 10 and the black keys 11, position sensors for detecting the positions of the white key 10 and the black key 11, both of which are not shown, and the like are provided below the white keys 10 and the black keys 11 or in the frame 20.

A key supporting section 21*a* that supports the central part of each of the white keys 10 and the black keys 11 is provided in such a manner that the front ends of the white key 10 and the black key 11 are pivotable in the vertical direction. The white key 10 and the black key 11 are pivotally supported by the key supporting section 21*a*, so that the white key 10 and the black key 11 pivot in the vertical direction about the support C1.

Each of the electromagnetic solenoids 30 includes a plunger 31 serving as a movable member and a driving section 32. The plunger 31 is made of a ferromagnetic material. The leading end of the plunger 31 is linked to the upper surface of the white key 10 at the rear side from the support C1 by the later-described link mechanism 40. The driving section 32 is composed of a magnetic frame 32*a*, a stationary core 32*b*, a bobbin 32*c*, and a coil 32*d*.

The magnetic frame 32*a* is made of a ferromagnetic material. The magnetic frame 32*a* has housed therein the plunger 31, the stationary core 32*b*, the bobbin 32*c*, and the coil 32*d*. An upper opening 32*a*1 and a lower opening 32*a*2 are formed at the upper surface and the lower surface of the magnetic frame 32*a*. The plunger 31 is housed in the magnetic frame 32*a* so as to have the lower end projecting from the lower opening 32*a*2 and so as to be movable in the vertical direction. The plunger 31 is mounted in such a manner that the upper end thereof projects from the upper opening 32*a*1 through a through-hole formed to the later-described stationary core 32*b*. The stationary core 32*b* is attached and fixed to the magnetic frame 32*a* for closing the upper opening 32*a*1. Specifically, the plunger 31 and the stationary core 32*b* are housed in the magnetic frame 32*a* as arranged side by side in the vertical direction.

The bobbin 32*c* is made of an insulating material. The bobbin 32*c* is formed into a cylindrical shape, wherein the plunger 31 and the stationary core 32*b* are stored in the cylinder. The coil 32*d* is made of a copper wire, and is wound around the bobbin 32*c*. The driving section 32 controls the attraction force exerted between the plunger 31 and the stationary core 32*b* through the control of the current flowing through the coil 32*d*, whereby the plunger 31 linearly moves in the vertical direction so as to apply an external force (a reaction force against the key depression) to the white key 10. The current flowing through the coil 32*d* is controlled by a computer not shown. The computer controls the current flowing through the coil 32*d* in order to obtain a key touch feeling, which is similar to that of a natural keyboard instrument, according to the position or speed of the white key 10, thereby controlling the external force (the reaction force against the key depression) applied to the white key 10. In FIG. 1, the driving unit 30 is provided to the white key 10, but the driving unit 30 is similarly provided to the black key 11 so as to apply the external force (the reaction force against the key depression).

Next, the link mechanism 40 between the plunger 31 of each of the electromagnetic solenoids 30 and each of the white keys 10 and the black keys 11 will be described below. As shown in FIGS. 2 and 3, the link mechanism 40 has a first electrode 41 serving as a first fixing portion, a second electrode 42 serving as a second fixing portion, and fine grains 43. The first electrode 41 is made of a plate-like conductive member. The lower surface of the first electrode 41 is fixed to the upper surfaces of the white key 10 and the black key 11 by an adhesive 50.

The second electrode 42 is made of a plate-like conductive member. A plunger mounting portion 42*a* to which the leading end of the plunger 31 is mounted is provided at the upper surface of the second electrode 42 so as to allow the second electrode 42 to be capable of pivoting in the vertical direction with respect to the plunger 31. The second electrode 42 is attached to the plunger 31 so as to be pivotable in the vertical direction about a support C2 by the plunger mounting portion 42*a*. Plural fine grains 43 are filled in a gap G1 between the upper surface of the first electrode 41 and the lower surface of the second electrode 42. The fine grain 43 is made of a spherical plastic fine grain having a diameter of 10 μm.

A voltage is applied between the aforesaid first electrode 41 and the second electrode 42 from a power supply E. Therefore, electrostatic attraction force (attraction force) is exerted on the first electrode 41 and the second electrode 42. By virtue of this attraction force, the first electrode 41 and the second electrode 42 are always kept to be horizontal as being apart from each other by the diameter of the fine grain 43.

Next, the operation at the link mechanism 40 of the keyboard apparatus 100 thus configured will be explained with reference to FIGS. 2 and 3. As shown in FIG. 2, the upper surfaces of the white key 10 and the black key 11 are kept to be horizontal in the initial state (key release state). Therefore, the first electrode 41 and the second electrode 42 are also kept to be horizontal, so that the plunger 31 is kept to be vertical with respect to the second electrode 42.

On the other hand, when the white key 10 and the black key 11 are depressed, the white key 10 and the black key 11 pivot in the clockwise direction about the support C1 as shown in FIG. 3. The first electrode 41 also pivots in the clockwise direction in the same manner of the white key 10 and the black key 11. Since the second electrode 42 is connected to the plunger 31 through the plunger mounting portion 42*a*, the second electrode 42 pivots in the clockwise direction about the support C2. By virtue of this movement, the first electrode 41 moves to the front, and the second electrode 42 moves to the rear. In this case, the first electrode 41 and the second electrode 42 relatively move in the longitudinal direction accompanied by the rotation of the spherical fine grains 43.

When the key release operation is performed afterward, the white key 10 and the black key 11 pivot in the counterclockwise direction about the support C1 in the figure. The first electrode 41 also pivots in the counterclockwise direction about the support C1 in the same manner of the white key 10 and the black key 11. Since the second electrode 42 is connected to the plunger 31 through the plunger mounting portion 42, the second electrode 42 pivots in the counterclockwise direction about the support C2. By virtue of this movement, the first electrode 41 moves to the rear, and the second electrode 42 moves to the front. In this case, the first electrode 41 and the second electrode 42 relatively move in the longitudinal direction accompanied by the rotation of the spherical fine grains 43.

According to the above-mentioned keyboard apparatus 100, the first electrode 41 and the second electrode 42 are connected to each other by the electrostatic attraction force that allows the first electrode 41 and the second electrode 42 to be close to each other. Further, the first electrode and the second electrode 42 relatively move in the longitudinal direction accompanied by the rotation of the spherical fine grains, whereby the friction force and looseness at the link mechanism 40 between the white key 10 and the black key 11 and the plunger 31 can be prevented as much as possible with a simple configuration.

According to the keyboard apparatus 100 described above, the electrostatic force that allows the first electrode 41 and the second electrode 42 to be close to each other can be generated with a simple configuration through the application of the voltage between the first electrode 41 and the second electrode 42.

b. Second Embodiment

Figure 4:
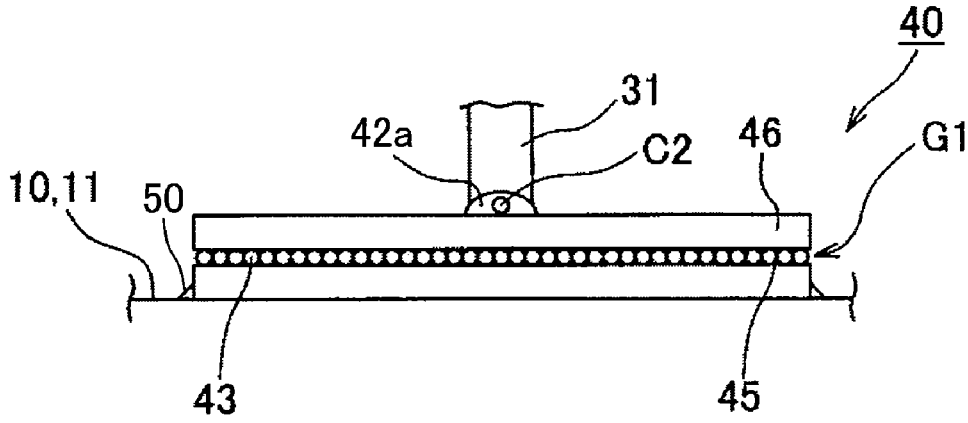
FIG. 4 is an enlarged view of the joint portion shown in FIG. 1 in its initial state (key release state) according to the second embodiment.

Subsequently, the second embodiment will be described with reference to FIG. 4. In FIG. 4, elements of the link mechanism 40 same as those explained in FIGS. 2 and 3 are identified by the same reference numeral, and the duplicate descriptions thereof are omitted. The keyboard apparatus 100 includes white keys 10, black keys 11, a frame 20, and electromagnetic solenoids 30, like the case of the first embodiment. These elements are identical with those in the first embodiment, so that the detailed descriptions thereof are omitted. The second embodiment greatly differs from the first embodiment in the configuration of the link mechanism 40. As shown in FIG. 4, the link mechanism 40 includes a first magnet 45 serving as a first fixing portion, a second magnet 46 serving as a second fixing portion, and fine grains 43. The first magnet 45 is formed into a plate-like shape. The lower surface of the first magnet 45 is fixed to the upper surfaces of the white key 10 and the black key 11 with an adhesive 50.

The second magnet 46 is formed into a plate-like shape. A plunger mounting portion 42*a* to which the leading end of the plunger 31 is mounted is provided at the upper surface of the second magnet 46 so as to allow the plunger 31 to be capable of pivoting in the vertical direction. The second magnet 46 is attached to the plunger 31 so as to be pivotable in the vertical direction about a support C2 by the plunger mounting portion 42*a*. Plural fine grains 43 are filled in a gap G1 between the upper surface of the first magnet 45 and the lower surface of the second magnet 46.

The first magnet 45 and the second magnet 46 are magnetized so as to generate a magnetic force that allows the first magnet 45 and the second magnet 46 to be close to each other, whereby a magnetic attraction force (attraction force) that allows the first magnet 45 and the second magnet 46 to be close to each other is exerted to the first magnet 45 and the second magnet 46. By virtue of this magnetic attraction force, the first magnet 45 and the second magnet 46 are always kept to be horizontal as being apart from each other by the diameter of the fine grain 43. The operation at the link mechanism 40 in the second embodiment is the same as the operation at the link mechanism 40 in the first embodiment, and the detailed description thereof is omitted.

According to the keyboard apparatus 100 described above, the first magnet 45 and the second magnet 46 are connected to each other by the magnetic attraction force that allows the first magnet 45 and the second magnet 46 to be close to each other. Further, the first magnet 45 and the second magnet 46 relatively move in the longitudinal direction accompanied by the rotation of the spherical fine grains, whereby the friction force and looseness at the link mechanism 40 between the white key 10 and the black key 11 and the plunger 31 can be prevented as much as possible with a simple configuration.

In the keyboard apparatus 100 described above, the first fixing portion and the second fixing portion are composed of the first magnet 45 and the second magnet 46, whereby the attraction force that allows the first magnet 45 and the second magnet 46 to be close to each other can be generated with a simple configuration without providing a power supply.

The above-mentioned attraction force is set to a value by which the first electrode 41 and the second electrode 42, and the first magnet 45 and the second magnet 46 are not separated from each other, even if the maximum value of the key release force, which is applied when a player plays the apparatus and is the force for releasing the plunger 31 from the white key 10 and the black key 11, is applied. The key release force becomes the greatest, when the white key 10 and the black key 11 are pounded to a full, through a strong depression of the white key 10 and the black key 11, to be in contact with a stopper. When the mass m of the plunger 31 of the electromagnetic solenoid 30 used in this case is set to 25 g, and the maximum acceleration a of the white key 10 and the black key 11 when they abut against the stopper through the strong depression is set to 20 G, the maximum value fmax of the key release force is represented by the eq. 1 described below.

$$f\max = m \times a = 0.025 \times 20 \times 9.8 = 4.9\text{N} \qquad \text{eq. 1}$$

Therefore, the attraction force of 4.9 N or more suffices.

Next, the voltage is obtained, which voltage is applied to the first electrode 41 and the second electrode 42, and by which the attraction force of 5N (≈4.9 N) is obtained. When the areas of the first electrode 41 and the second electrode 42 are defined as S, the distance between the first electrode 41 and the second electrode 42 is defined as X, the applied voltage is defined as V, the dielectric constant of the material between the first electrode 41 and the second electrode 42 is defined as $\epsilon r$, and the dielectric constant in the vacuum is defined as $\epsilon 0$, the electrostatic attraction force F applied to the first electrode 41 and the second electrode 42 is represented by the eq. 2 described below.

$$F=(\epsilon 0\times\epsilon r\times V^2\times S)/(2\times X^2) \quad \text{eq. 2}$$

Therefore, when S=10 mm×25 mm, X, which is the diameter of the fine grain 43 equals to 10 μm, $\epsilon r=8.83\times10^{-12}$, and $\epsilon 0=3$, the electrostatic attraction force F is represented by the eq. 3 described below.

$$F=\frac{(3\times8.85\times10^{-12}\times10\times10^{-3}\times25\times10^{-3}\times V^2)}{(2\times10^{-5}\times10^{-5})} \quad \text{eq. 3}$$
$$=33.2\times10^{-6}\times V^2$$

The voltage V by which the attraction force of 5 (≈4.9) is obtained is represented by eq. 4 described below.

$$V=(5/33.2)^{1/2}\times10^3\approx388\text{ V} \quad \text{eq. 4}$$

Therefore, the voltage applied between the first electrode and the second electrode of about 400V suffices.

Next, the first magnet 45 and the second magnet 46 by which the attraction force of 4.9N is obtained is obtained in the second embodiment. When the magnetic flux of the first magnet 45 and the second magnet 46 is defined as B, the areas of the first magnet 45 and the second magnet 46 are defined as S, and the magnetic permeability in the vacuum is defined as u0, the force F applied between the first magnet 45 and the second magnet 46 is represented by eq. 5 described below.

$$F=(B^2\times S)/(2\times u0) \quad \text{eq. 5}$$

Figure 5:
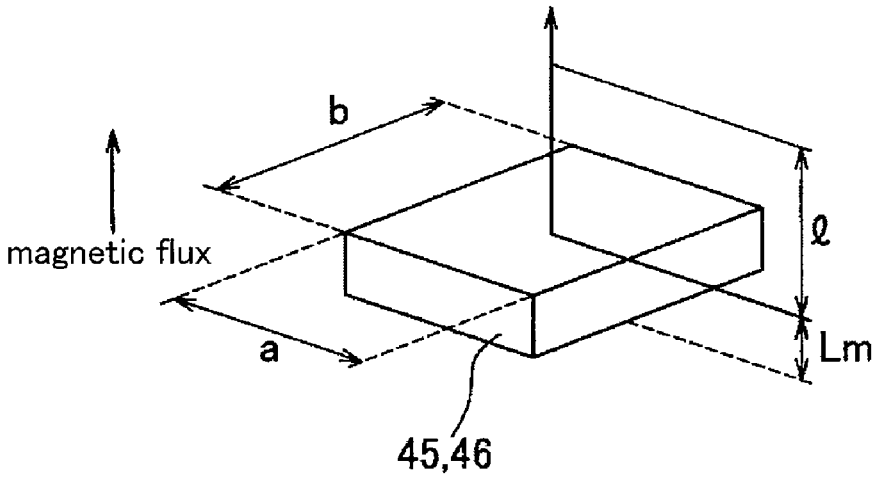
FIG. 5 is a perspective view of a first magnet and a second magnet shown in FIG. 4.

The method of calculating the magnetic flux B at the position apart from the magnet having a square pole (a×b×Lm), shown in FIG. 5, by the distance I is represented by eq. 6 described below.

When Br (residual magnetic flux)=500 mT, a=10 mm, b=25 mm, Lm=10 mm, and I=10 μm (diameter of the fine grain 43) in the case of a cheap ferrite, B=221 mt. Accordingly, if the magnet having the size and magnetic flux as described above is used for the first magnet 45 and the second magnet 46, the magnetic attraction force of 4.9 N can be obtained as represented by eq. 7 described below.

$$F=(0.221\times0.221\times25\times10^{-4})/(2\times1.25\times10^{-6})=4.9(N) \quad \text{eq. 7}$$

Figure 6A:
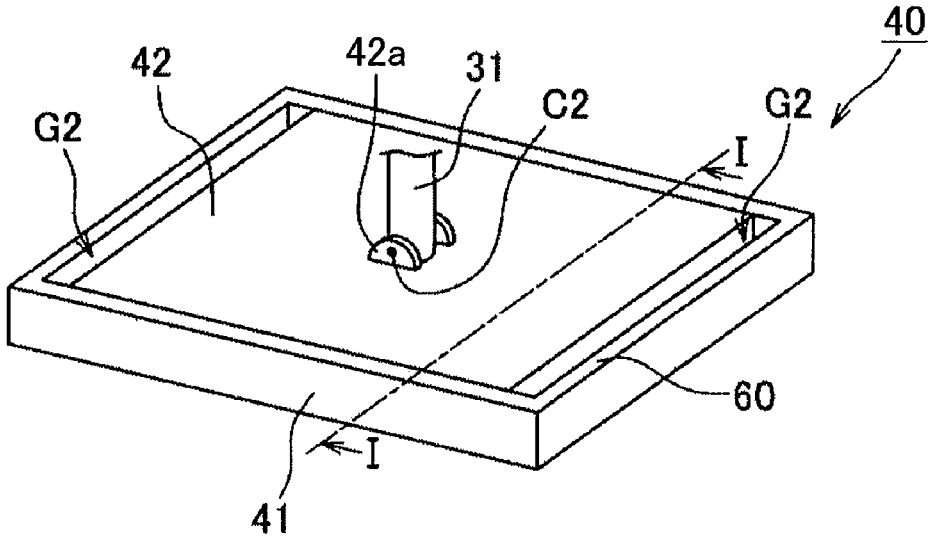
FIG. 6A is a perspective view showing a first magnet, a second magnet, a first electrode, and a second electrode in another embodiment.
Figure 6B:
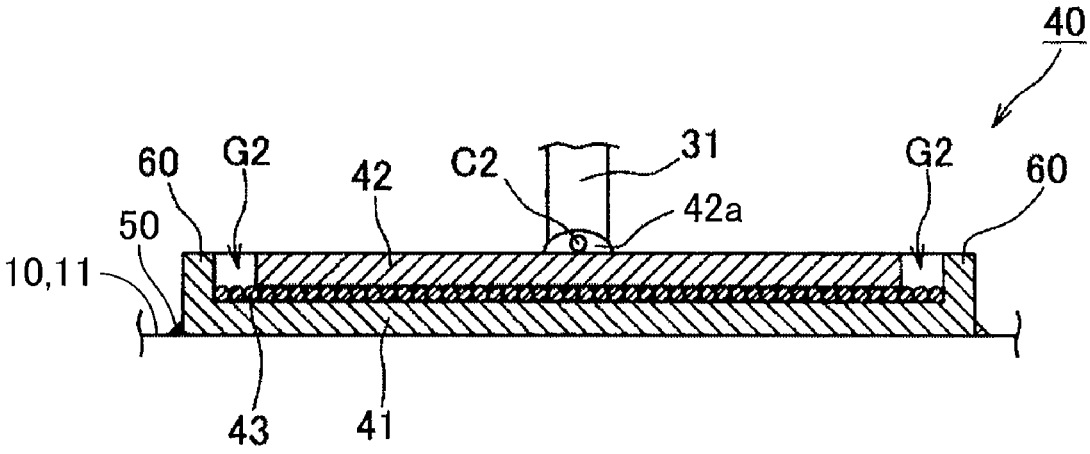
FIG. 6B is a sectional view taken along a line I-I in FIG. 6A.

Although the first electrode 41 and the second electrode 42 are formed into a flat plate in the first embodiment, the invention is not limited thereto. For example, it is considered that a fall prevention projection 60 for preventing the fine grains 43 from falling is mounted. The fall prevention projection 60 is mounted to the first electrode 41 so as to enclose the edge portion of the second electrode 42 and to project toward the second electrode 42 as shown in FIGS. 6A and 6B. A gap G2 should be formed between the fall prevention projection 60 and the edge portion of the second electrode 42 in the longitudinal direction by at least the amount of the movement of the second electrode 42 relative to the first electrode 41 upon the key depression. By virtue of the provision of the fall prevention projection 60, the fine grains 43 do not fall from the gap G1 between the first electrode 41 and the second electrode 42, even if the electrostatic attraction force is not applied because the application of the voltage to the first electrode 41 and the second electrode 42 is stopped.

As shown in FIGS. 6A and 6B, it is optimum that the fall prevention projection 60 is formed to the first electrode 41 arranged at the lower part in the vertical direction, but the fall prevention projection 60 may be formed to the second electrode 42. Specifically, the fall prevention projection 60, which projects toward the other one of the first electrode 41 and the second electrode 42 so as to enclose the other one for preventing the fine grains 43 from falling, may be formed to either one of the first electrode 41 and the second electrode 42. Further, the fall prevention projection 60 may be formed to either one of the first magnet 45 and the second magnet 46.

Figure 7:
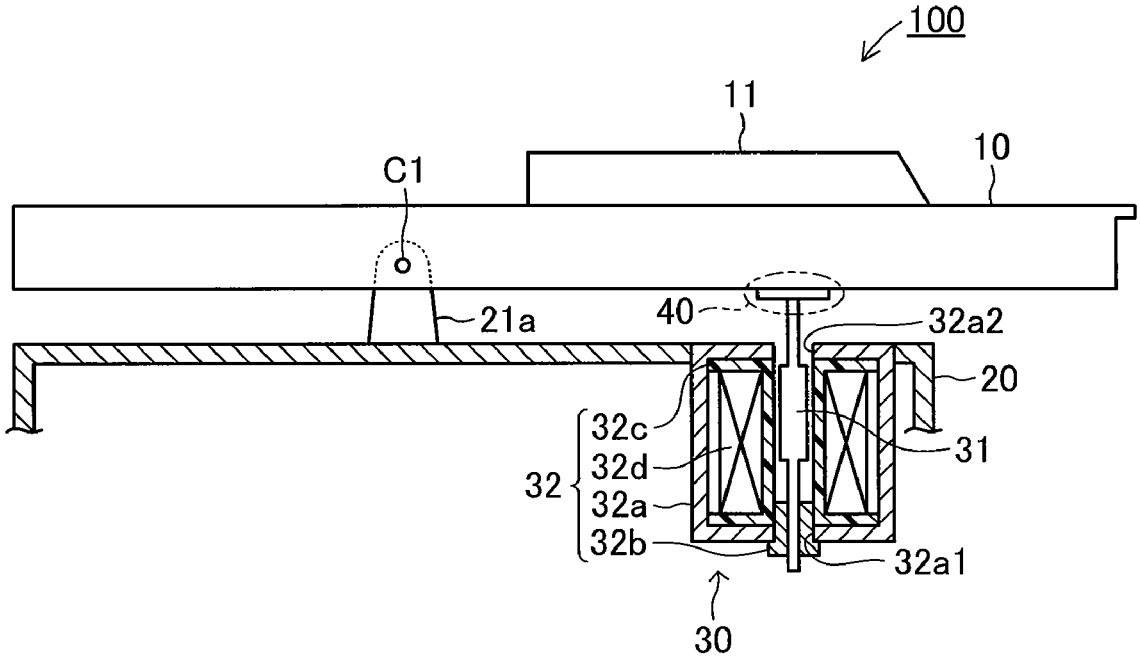
FIG. 7 is a schematic sectional view of a keyboard apparatus according another embodiment of the present invention.

The plunger 31 is connected to the upper surfaces of the white key 10 and the black key 11 at the rear side from the support C1 in the first embodiment, but the invention is not limited thereto. For example, the plunger 31 may be connected to the lower surfaces of the white key 10 and the black key 11 at the rear side from the support C1. As shown in FIG. 7, the plunger 31 may be connected to the lower surfaces of the white key 10 and the black key 11 at the front side from the support C1, or to the upper surfaces of the white key 10 and the black key 11 at the front side from the support C1.

In the second embodiment, the first and second fixing portions are composed of the first and second magnets 45 and 46, which are both magnets. However, instead of this configuration, one of the first and second fixing portions may be composed of a magnet, and the other may be composed of an iron plate that is the magnetic material.

The embodiment described above is only illustrative, and the present invention is not limited to the embodiment described above. Specifically, various modifications are possible without departing from the scope of the present invention.

What is claimed is:

1. A keyboard apparatus comprising:

plural keys that extend in the longitudinal direction, and pivot in the vertical direction about a support by an operation of a key depression and an operation of a key release;

plural electronic actuators that apply a reaction force against the operation of depressing the plural keys, each of the plural electronic actuators having a movable member that displaces in the vertical direction in interlocking with the pivot movement of each of the keys; and plural link mechanisms that link the plural keys and the movable members of the plural electronic actuators respectively, wherein each of the plural link mechanisms includes:

a plate-like first fixing portion that is fixed to each of the keys, a plate-like second fixing portion that is connected to each of the movable members; and plural spherical fine grains filled in a gap between the first fixing portion and the second fixing portion.

2. A keyboard apparatus according to claim 1, wherein each of the plural electronic actuators is an electromagnetic solenoid.

3. A keyboard apparatus according to claim 1, wherein the first fixing portion and the second fixing portion are made of a conductive material, and voltage is applied between the first fixing portion and the second fixing portion so as to generate an electrostatic attraction force between the first fixing portion and the second fixing portion.

4. A keyboard apparatus according to claim 1, wherein at least one of the first fixing portion and the second fixing portion is made of a magnet so as to generate an attraction force, caused by a magnetic force, between the first fixing portion and the second fixing portion.

* * * * *